United States Patent [19]

Schillinger

[11] 4,155,450

[45] May 22, 1979

[54] GLASSWARE CARRIER

[75] Inventor: Joseph F. Schillinger, Palos Hills, Ill.

[73] Assignee: Champion International Corporation, Stamford, Conn.

[21] Appl. No.: 898,295

[22] Filed: Apr. 20, 1978

[51] Int. Cl.[2] ..... B65D 5/04; B65D 85/62

[52] U.S. Cl. ..... 206/434; 206/426; 229/40; 229/41 B

[58] Field of Search ..... 206/426, 434, 189, 194; 229/40, 41 B

[56] References Cited

U.S. PATENT DOCUMENTS

| | | | |
|---|---|---|---|
| 3,554,431 | 1/1971 | Lock | 206/434 |
| 3,598,302 | 8/1971 | Nowak | 229/40 |
| 3,854,580 | 12/1974 | Hennessey | 229/40 |
| 3,931,888 | 1/1976 | Fogel | 229/40 |
| 4,037,721 | 7/1977 | Schillinger | 206/426 |

*Primary Examiner*—William T. Dixson, Jr.

*Attorney, Agent, or Firm*—Evelyn M. Sommer

[57] ABSTRACT

A receptacle for carrying and displaying glassware formed from a blank comprising a single sheet of paper stock. The receptacle includes an open front and rear rectangular parallelopiped sleeve having a top, a bottom, and opposite side walls connecting the top and bottom wall, all of which are hinged to each other. Four cylindrical glassware items can be supported within the receptacle and displayed between a divider wall provided along the interior of the bottom and top wall and the outer edges of the receptacle. The divider wall is collapsible within the interior of the receptacle so as to enable the receptacle sides, top, and bottom, to pivot relative to each other and assume a substantially flat state for transportation and storage. A divider wall latching mechanism is movable from a first position which latches the divider wall in its upright position to a second position which allows the divider wall to collapse and thus cause the carrier to assume its flat state.

12 Claims, 9 Drawing Figures

FIG. 7
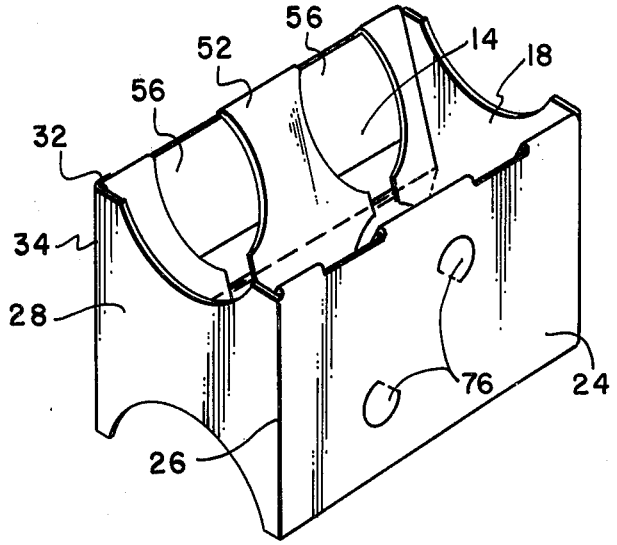
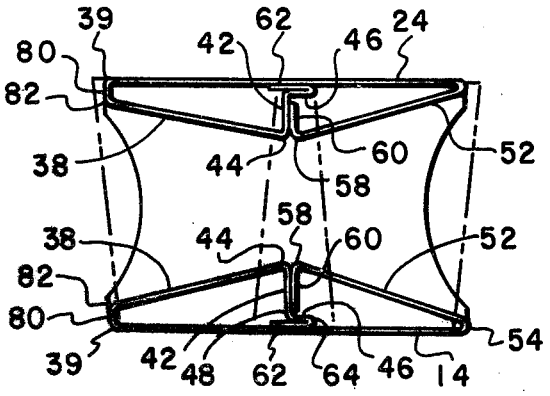
FIG. 8
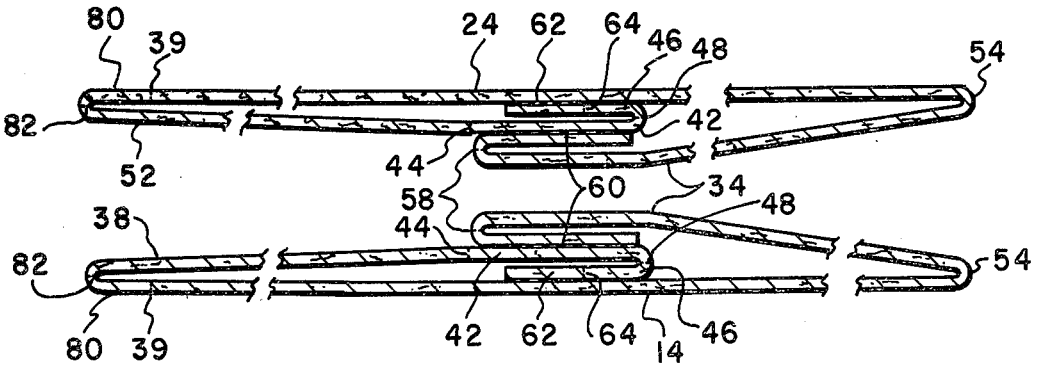
FIG. 9

GLASSWARE CARRIER

BACKGROUND OF THE INVENTION

This invention relates to a special receptacle, and more particularly, a receptacle designed for displaying glassware, such as generally cylindrical tumblers, in a retail establishment and for transporting the tumblers from one location to another in a safe and secure manner.

Various types of carriers have been produced for carrying objects such as tumblers or the like, and in most cases these carriers are closed to better protect the product.

One such carrier is disclosed in U.S. Pat. No. 3,598,302 to William W. Nowak issued Aug. 10, 1971. This patent is directed to a carrier for objects of this type which comprised an open-ended sleeve designed to hold the product in position so that it could be displayed. The product was held in place by locking panels hinged to the top and bottom edges of the sleeve and folded inwardly toward the center of the sleeve. These locking panels were provided with elliptical openings therein to snugly fit about the wall of the generally cylindrical objects. This provided a means of engaging the opposite ends of the objects to hold them contained within the sleeve. The locking panels were held in place by a central strut which engaged the inclined panels and held them from unfolding. Once assembled, however, the sleeve could not be knocked down or collapsed for storage, shipment, or reuse, thereby requiring assembly directly from a blank at the point of use, which is expensive, time-consuming, and extremely inconvenient.

Of almost identical construction is the carrier of U.S. Pat. No. 3,854,580, issued Dec. 17, 1974, to Russell J. Hennessey, except additional locking tabs are formed in the top panel of the sleeve for holding the walls of the glassware against movement in the carrier. These tabs contact the interior wall of each glass supported by the carrier.

U.S. Pat. No. 3,931,888, issued Jan. 13, 1976, to Wesley S. Fogel relates to a carrier of the same general type but is provided with pressure applying panels to rigidify the retained glassware. As with U.S. Pat. Nos. 3,598,302 and 3,854,580, the carrier, once assembled, cannot be collapsed to a substantially flat state.

U.S. Pat. No. 4,037,721, issued July 26, 1977, to Joseph F. Schillinger overcame one of the problems of the prior art by providing a carrier with a center wall collapsible within the interior of the receptacle after assembly of the blank so as to enable the receptacle sides, top, and bottom, to pivot relative to each other and assume a substantially flat state for transportation and storage until needed to supply a plurality of partial elliptical openings for retaining glassware items between the top and bottom center walls. The center wall is locked in its upright condition by tabs integral with a panel comprising a portion of each central wall. Each tab is received through a correspondingly located and aligned slot in a second panel comprising a portion of the center wall. When desired, the receptacle can be collapsed for convenient storage and future use by merely removing the tabs from the elongated slots and pivoting the top and bottom panels and the side panels about their related score lines to a substantially flat condition.

Although enabling the container to be collapsed for storage and shipment, the use of tabs inserted in associated slots for a locking mechanism has not proved entirely satisfactory inasmuch as the desired rigidity of the container is not achieved. A loose fit of the tabs in their associated slots allows relative movement between the parts.

SUMMARY OF THE INVENTION

In accordance with the present invention, a special carrier is formed from a single planar blank which, once assembled, can be collapsed to a substantially flat state for transportation and storage until needed for carrying and displaying glassware.

Briefly stated, the present invention is directed to a receptacle for displaying and carrying glassware comprising a substantially rectangular parallelopiped sleeve having a top wall, a bottom wall, a pair of side walls, and an open front and rear surface, collapsible to a substantially flat configuration about hinged lines connecting said walls at their lateral edges, a substantially upright L-shaped divider wall secured to the interior of each of said top and bottom walls extending between said pair of side walls, a support panel secured between said bottom wall and the divider wall on each side of said divider wall and said top wall and the divider wall on each side of said divider wall, each of said support panels being disposed at an acute angle with respect to the top and bottom wall to which it is secured and having at least one opening for receiving an item of glassware disposed between the openings adjacent said top and bottom walls on the same side of each of said divider walls, and a divider wall latching means for each said divider wall comprising a movable panel hingedly connected between said divider wall and said adjacent top or bottom walls and capable of being moved from a first horizontal position locking said divider wall upright relative to an adjacent top or bottom wall and a second horizontal position 180° removed from said first horizontal position thereby unlocking and collapsing said divider wall.

BRIEF DESCRIPTION OF THE DRAWINGS

Further objects and advantages of the invention will become apparent from the following description and claims and from the accompanying drawings, wherein:

FIGS. 4 to 7, inclusive, are perspective views of the various stages of the assembly of the blank of FIG. 1 to form the receptacle of FIG. 2;

FIG. 8 is a cross-sectional view taken substantially along the plane indicated by the line 8—8 of FIG. 2; and FIG. 9 is a cross-sectional view taken substantially along the plane indicated by line 9—9 of FIG. 3.

DETAILED DESCRIPTION

Figure 1:
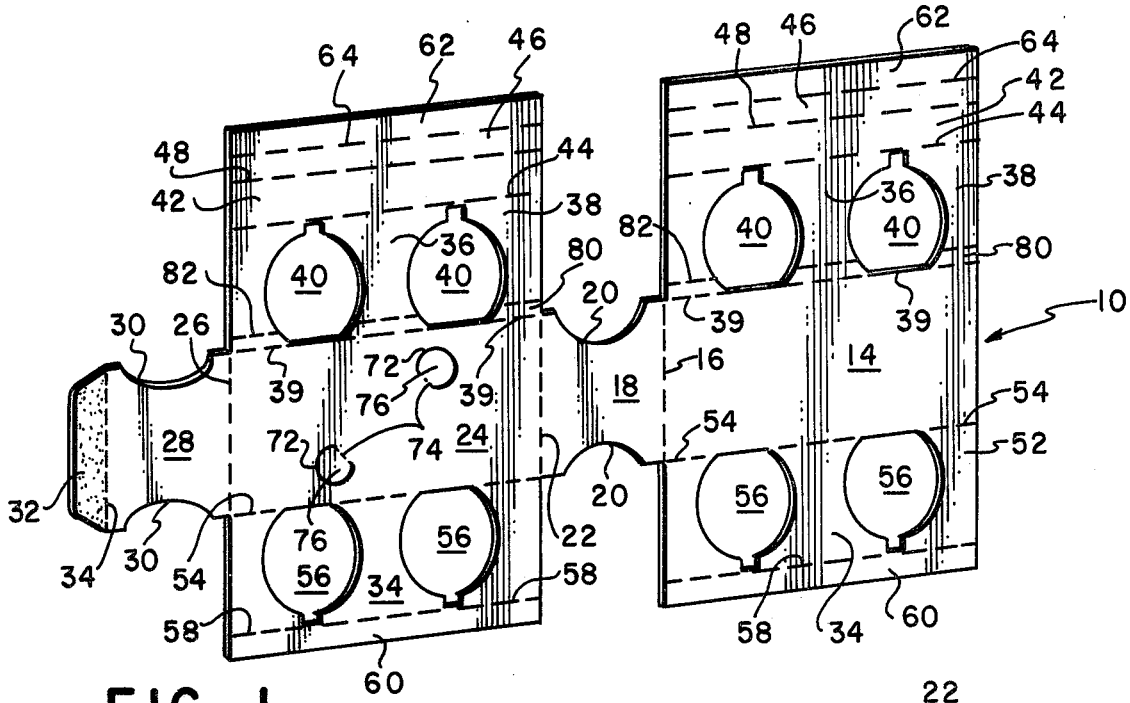
FIG. 1 is a front perspective view of a blank for forming the glassware receptacle of the present invention.
Figure 2:
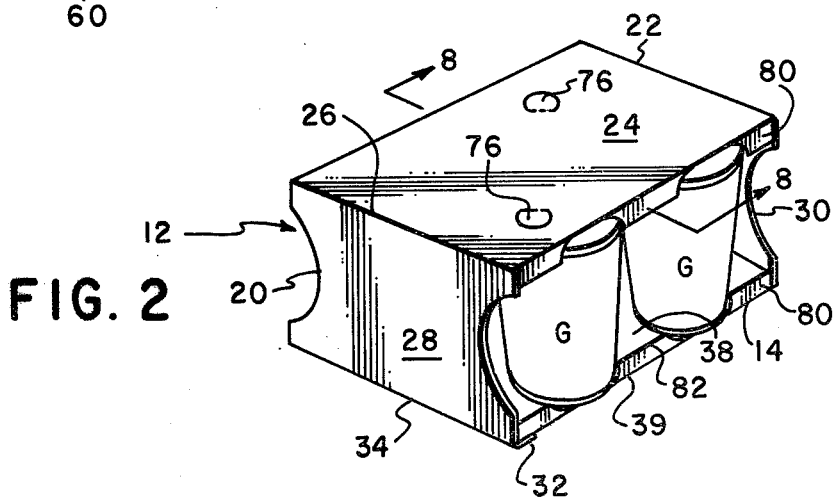
FIG. 2 is a perspective view of the glassware receptacle of the invention formed from the blank of FIG. 1.

Referring now to the drawings in detail, wherein like numerals indicate like elements throughout the several views, the blank 10 used to form the receptacle 12 of the present invention includes a substantially planar sheet of material, such as cardboard, having a substantially rectangular panel 14 connected by a score line 16 to a second panel 18 having arcuate edges 20. This pattern is repeated once more in that panel 18 is connected by score line 22 to a second rectangular panel 24 connected by a score line 26 to a second panel 28 having arcuate edges 30. In addition, second panel 28 has a flat or extension 32 connected by a score line 34 to one end of panel 28.

Each of the rectangular panels 14 and 24 include lateral extension panels 34 and 36. Each of the extended panels 36 include a first portion 38 connected by a score line 39 to panels 14 and 24 and is provided with a pair of partial elliptical openings 40 cut therein and disposed in side-by-side relationship. A second portion 42 which is generally rectangular in shape is connected by a score line 44 to portion 38. A third portion 46, which is also generally rectangular in shape, is connected by a score line 48 to second portion 42 of lateral extension 36. A fourth portion 62 is connected by a score line 64 to third portion 46. Extended panel 36 includes a panel strip 80 generally rectangular in shape and hingedly attached at score line 82.

Each lateral extension panel 34 includes a first portion 52 bendable with respect to rectangular panel 14 and 24 about a score line 54. A pair of partial elliptical openings 56 are cut in first portion 52 of extension panel 34 and disposed in side-by-side relationship. Each of the openings 56 is aligned, respectively, with one of the openings 40 in portion 38 of panel 36. First portion 52 of panel 34 is connected by a score line 58 to a second rectangular portion 60 of extension 34.

The blank construction is completed by cutting a pair of substantially semi-circular lines 72 in rectangular panel 24 each of which will bend about a score line 74 thus forming tabs 76.

In order to assemble the receptacle 12, as shown in FIGS. 4–7, inclusive, the panels 14, 18, 24, and 28 are bent at score lines 16, 22, and 26, respectively, to form a substantially rectangular parallelopiped edge sleeve having an open front and back. To retain the panels in such a configuration, tab 32 hingedly connected to panel 28 by score line 34 is bent relative to panel 28 and adhesively secured to the other surface of panel 14. Panel 14 thus forms the bottom of receptacle 12 while rectangular panel 24 constitutes the top. Panels 18 and 28 form the sides. Lateral extensions 34 and 36 are bent about score lines 54 and 39, respectively, of each panel 14 and 24 to be disposed within the interior of the receptacle through the open front and back areas. Thus, lateral extensions 34 and 36 become support panels for the glassware to be contained in the receptacle.

Fourth portion 62 of each of the extensions 36 is adhesively connected to approximately the middle of each of the top and bottom rectangular wall panels 14 and 24, respectively. This is accomplished by bending second, third and fourth portions 42, 46 and 62, respectively, of each extension 36 about score lines 44, 48 and 64, respectively, after each lateral extension 36 has been bent about score line 39 to dispose the extension within the interior of receptacle 12.

Thus, second portion 42 forms a divider wall when in the upright position relative to the adjacent top wall 24 or bottom wall 14 as shown in FIG. 8.

Third portion 46 is a movable panel hingedly connected between divider wall 42 at score line 48 and the adjacent top wall 24 or base wall 14 (fourth portion 62 is adhesively secured to the adjacent top wall or bottom wall) at score line 64. Panel 46 is thus capable of being moved from a first horizontal position locking said divider wall 42 upright relative to an adjacent top or bottom wall 24 or 14 as shown in FIG. 8 to a second horizontal position 180° removed from said first horizontal position thereby unlocking and collapsing said divider 42 to a horizontal position as shown in FIG. 9.

Panel strip 80 which is hingedly connected between extended panel 36 and top or bottom wall portion 24 and 14, respectively, at score lines 39 and 82, respectively, allows the base of extended panel 36 at score line 82 to move outwardly from container 12 when said divider wall 42 collapses. See FIG. 9.

In a like manner, lateral extension 34 is bent about score line 54 and second portion 60 of extension 34 is bent about score line 58 and the rear surface thereof is adhesively connected to the rear surface of second portion 42 of extension 36 as shown in FIG. 8.

Figure 3:
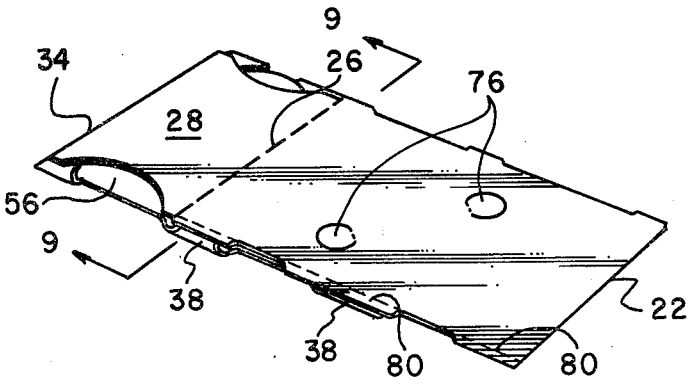
FIG. 3 is a perspective view of the glassware receptacle of FIG. 2 collapsed for storage and transportation after it has been assembled from the blank of FIG. 1.
Figure 4:
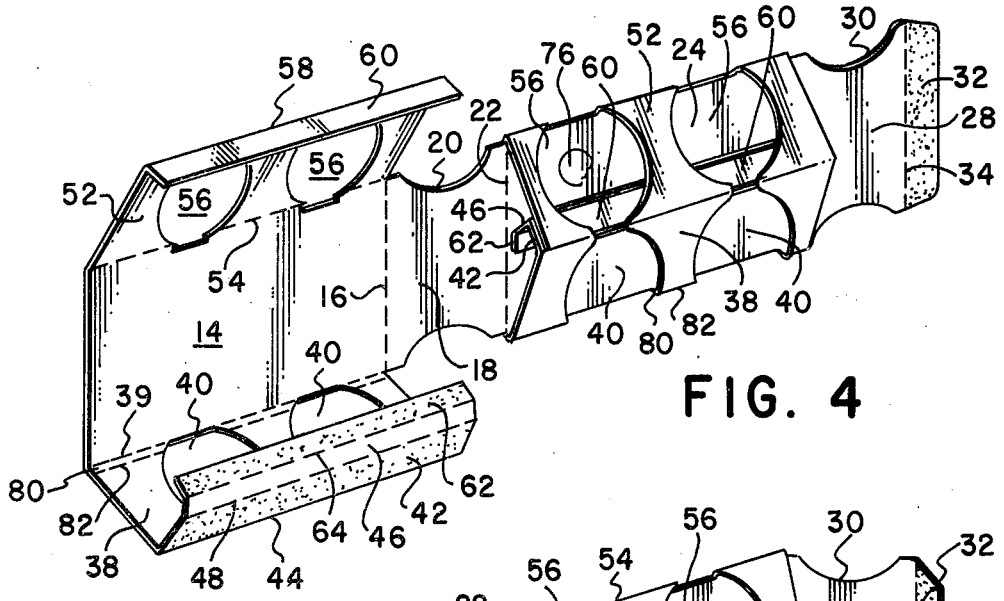
Figure 5:
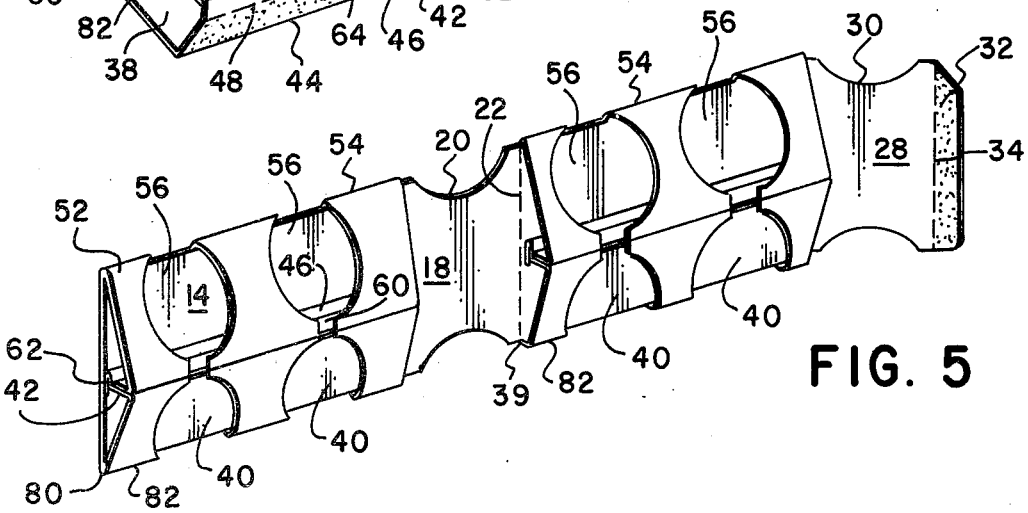
Figure 6:
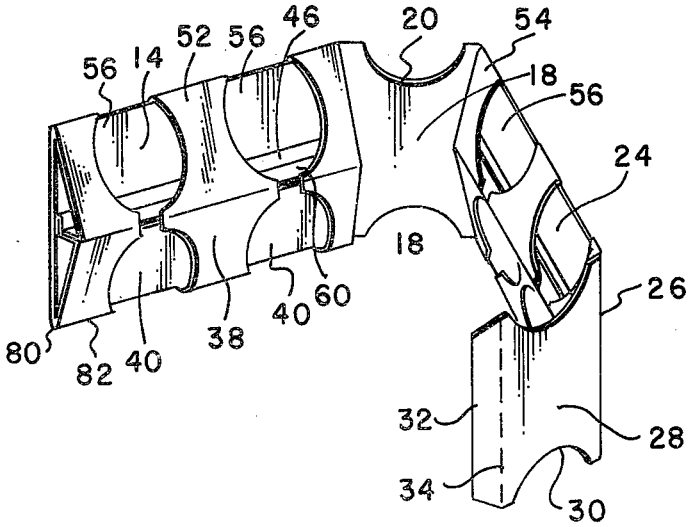

In this configuration, receptacle 12 can be collapsed to a substantially flat condition as shown in FIG. 3 for transportation, storage and reuse. When collapsed, second portion 42 of lateral extension 36 overlaps third and fourth portions 46 and 62 as shown in FIG. 9.

To assemble the carrier in a stable and non-collapsible state for use in receiving and displaying a cylindrical glassware item or to carry it, it is only necessary that second portion 42 of each lateral extension 36 be pivoted to a substantially upright position relative to rectangular top and bottom panels 14 and 24 about score lines 44, 48 and 64. This will cause movable panel 46 to pivot about score line 64 and score line 48 and move from its horizontal position shown in FIG. 9 to a horizontal position 180° opposed as shown in FIG. 8 thus locking center or divider wall 42 in the upright position. In this position, portions 60 and 42 are adhesively attached in a back-to-back relationship.

When receptacle 12 is so assembled, openings 56 in lateral extension 34 and openings 40 in lateral extension 36 will be vertically aligned adjacent the interior of the top and bottom rectangular panels 24 and 14. The openings 40 and 56 in first portions 38 and 52, respectively, of lateral extensions 36 and 34, respectively, which are aligned, slope rearwardly towards each other from the front to the back of the receptacle 12, as the first portions 38 and 52 are disposed at an acute angle with respect to the top and bottom rectangular panels 24 and 14. The openings being elliptical, assume a circular projection in plan. Accordingly, a cylindrical glassware item G can be disposed within a pair of the aligned openings 40 and 56 and will contact and be retained by the sides of the openings, while further stabilizing the receptacle 12. Due to the open front and back surfaces of receptacle 12, along with the arcuate sides of the sidewalls 18 and 28, the glassware will be clearly visible for display purposes.

Although the drawings illustrate an embodiment of the invention for carrying and displaying four cylindrical glassware items, it will be evident that the blank 10 can be suitably lengthened to provide for additional openings 40 so that six, eight, or more cylindrical glassware items can be carried and displayed in a single carrier As to materials of construction, any of the usual materials for constructing such carriers can be employed with conventional paper stock being preferred.

In order to carry the receptacle 12, it is only necessary to depress tab 76 formed in the top rectangular panel 24 by the semi-circular cut line 72. The tabs are depressed about score line 74 to provide convenient finger-receiving openings to carry the glassware receptacle 12 and glassware G.

If desired, the receptacle 12 can be collapsed for convenient storage and future reuse by merely pulling up or lifting central or divider wall 42 and pivoting movable panel 46 about score lines 64 and 48 from its horizontal position shown in FIG. 8 to a horizontal position 180°opposed as shown in FIG. 9. Thus central or divider wall 42 with panel 60 adhesively attached thereto pivots about score lines 48 and 58 into a horizontal position. To allow this to happen, panel strip 80, as shown in FIG. 8, is pivoted outwardly about score line 39 and score line 82 thus allowing support for extended panel 36 to move outwardly from container 12. The top and bottom panels 24 and 14, as well as side panels 18 and 28, can then be pivoted about score lines 16, 22, 26 and 34 to a substantially flat condition. Obviously, top panel strip 80 could be on one side of the carrier and bottom panel strip 80 could be on the other side of the carrier. It is preferred that they both be on the same side.

While the invention has been described in connection with a preferred embodiment, it is not intended to limit the scope of the invention to the particular form set forth, but, on the contrary it is intended to cover such alternatives, modifications, and equivalents as may be included within the spirit and scope of the invention as defined by the appended claims.

What is claimed is:

1. A receptacle for displaying and carrying glassware comprising:

a. a substantially rectangular parallelopiped sleeve having a top wall, a bottom wall, a pair of side walls, and an open front and rear surface, collapsible to a substantially flat configuration about hinged lines connecting said walls at their lateral edges, b. a substantially upright L-shaped divider wall secured to the interior of each of said top and bottom walls extending between said pair of side walls, c. a support panel secured between said bottom wall and the divider wall on each side of said divider wall and said top wall and the divider wall on each side of said divider wall, d. each of said support panels being disposed at an acute angle with respect to the top and bottom wall to which it is secured and having at least one opening for receiving an item of glassware disposed between the openings adjacent said top and bottom walls on the same side of each of said divider walls, and e. a divider wall latching means for each said divider wall comprising a movable panel hingedly connected between said divider wall and said adjacent top or bottom walls and capable of being moved from a first horizontal position locking said divider wall upright relative to an adjacent top or bottom wall and a second horizontal position 180° removed from said first horizontal position thereby unlocking and collapsing said divider wall.

2. The receptacle of claim 1 further including:

a. a top and bottom panel strip hingedly connected between the base of one of said support panels and said top wall and the base of one of said support panels and said bottom wall, respectively, whereby said one support panel base is allowed to move inwardly and outwardly from said container when said divider wall is locked upright or collapsed, respectively.

3. The receptable of claim 1 including tab means on said top wall pivotable about a score line to form a finger-receiving opening for carrying said receptacle.

4. The receptacle of claim 1 wherein each of said openings is at least partially elliptical.

5. The receptacle of claim 1 wherein each of said side walls is a pair of opposed arcuate edges.

6. The receptacle of claim 2 wherein said top and bottom panel strips are both on the same side of said carrier.

7. The receptacle of claim 2 wherein said top and bottom panel strips are on opposite sides of said carrier.

8. A blank comprising a single sheet of paper stock for forming the receptacle of claim 1.

9. A blank comprising a single sheet of paper stock for forming the receptacle of claim 2.

10. A blank comprising a single sheet of paper stock for forming the receptacle of claim 3.

11. A blank comprising a single sheet of paper stock for forming the receptacle of claim 4.

12. In a receptacle for displaying and carrying glassware and having a substantially rectangular parallelopiped sleeve with a top wall, a bottom wall, a pair of side walls, and an open front and rear surface, collapsible to a substantially flat configuration about hinge lines connecting said walls at their lateral edges, a substantially upright divider wall secured to the interior of each of the top and bottom walls and extending between the pair of side walls, a support panel secured between the bottom wall and the divider wall on each side of the divider wall and the top wall and the divider wall on each side of the divider wall, each of the support panels being disposed at an acute angle with respect to the top and bottom wall to which it is secured and having at least one opening for receiving an item of glassware disposed between the openings adjacent the top and bottom walls on the same side of each of the divider walls, an improved, upright, L-shaped, collapsible divider wall comprising:

a. an upright member having first and second panels secured in a face to face relationship and each being hingedly connected to a corresponding adjacent one of said support panels, and b. a horizontal member completing an L with said upright member and having first and second panels, said first horizontal panel being secured to the adjacent top or bottom wall, said second horizontal member being hingedly connected to both the lower portion of one one of said upright members and to the outermost end of said first horizontal member forming said L whereby said second horizontal member is capable of being pivoted from a first horizontal position locking said secured first and second panels in an upright position to form a wall and a second horizontal position 180° removed from said first horizontal position unlocking said attached second panels from their upright position and collapsing said secured first and second panels to a horizontal position.

* * * * *